US006383020B2

(12) United States Patent
Taguchi et al.

(10) Patent No.: US 6,383,020 B2
(45) Date of Patent: May 7, 2002

(54) CONNECTOR WITH HOLDER PREVENTED FROM COMING-OFF

(75) Inventors: Naoto Taguchi; Tohru Kurosawa, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/785,323

(22) Filed: Feb. 20, 2001

(30) Foreign Application Priority Data

Feb. 23, 2000 (JP) ..... 2000-045530

(51) Int. Cl.[7] ..... H01R 13/436
(52) U.S. Cl. ..... 439/587; 439/752
(58) Field of Search ..... 439/752, 595, 439/587–589, 274, 275

(56) References Cited

U.S. PATENT DOCUMENTS 5,645,451 A * 7/1997 Ohsumi et al. ..... 439/587
5,928,038 A * 7/1999 Berg et al. ..... 439/752
6,004,158 A * 12/1999 Ward ..... 439/752
6,010,374 A * 1/2000 Miwa ..... 439/752
6,071,147 A * 6/2000 Tsukamoto ..... 439/587
6,179,671 B1 * 1/2001 Ohsumi ..... 439/752

* cited by examiner

*Primary Examiner*—Gary Paumen
(74) *Attorney, Agent, or Firm*—Armstrong, Westerman & Hattori, LLP

(57) ABSTRACT

A connector with a holder prevented from coming-off is provided, whereby an unexpected breakaway of the holder can be securely prevented from occurring and an incomplete assembly of the holder with the connector housing can be securely detected. The connector with a holder prevented from coming-off includes: a connector housing 2; a holder 6 mounted on a surface of the connector housing 2; a spacer 7 inserted into the middle of the connector housing 2 from a direction crossing at right angles with the mounting direction of the holder 6; a locking member 32 protrudingly formed to the holder 6; a locking part 41 for locking formed to the locking member 32; and an engaging part 51 for engaging with the locking part 41 formed to the spacer 7, wherein the engaging part 51 engages with the locking part 41 when the holder 6 is completely mounted.

8 Claims, 10 Drawing Sheets

CONNECTOR WITH HOLDER PREVENTED FROM COMING-OFF

BACKGROUND OF THE INVENTION (1) Field of the Invention

This invention relates to a connector with a holder prevented from coming-off and, more specifically, to a connector with a rear holder prevented from coming-off, in which terminals having a wire are inserted in a connector housing of the connector, a waterproof packing is mounted therein, the rear holder presses the waterpoof packing, and the terminals are doubly locked by a side spacer.

(2) Description of the Related Art

FIG. 18 illustrates a conventional connector 81 having a rear holder 85.

The connector 81 consists of a connector housing 82 made of synthetic resin, a plate-shaped waterproof packing (sealing member) 84 made of synthetic rubber, which is fit into a rear opening 83 of the connector housing 82 in a condition that terminals (not shown in the figure) having a wire are inserted into the connector housing 82, and the rear holder 85 made of synthetic resin, which is fixed on the rear of the connector housing 82 in order to prevent the waterproof packing 84 from coming off from the connector housing 82.

At each sidewall of the connector housing 82, there are formed a guiding projection 86 and a locking projection 87 for mating with the rear holder 85. The rear holder 85 is formed in a rectangular frame-shape, at each side of which a locking frame 88 engaging with the locking projection 87 is formed protrudingly forward. The waterproof packing 84 has a plurality of insertion holes 89, into which each wire (not shown in the figure) is inserted to be appressed therein.

There is a known construction, in which each waterproof rubber stopper (sealing member) is fit to the respective terminal receiving chamber of the connector housing 82 instead of the palte-shaped waterproof packing 84 and each rear holder (not shown in the figure) having a plate-shape presses the respective waterproof rubber stopper. There is also a known construction, in which shafts for locking terminals are protrudingly formed from a rear holder so that the terminals inserted in a connector housing are doubly locked together with locking lances (not shown in the figure) of the connector housing. Furthermore, there is a known construction, in which a connector housing is provided with a front holder.

However, as to these conventional connectors with the rear holder, when some external force is applied to the rear holder 85 after the assembly of the rear holder 85, there is some anxiety that the locking of the rear holder 85 might be unexpectedly released resulting in coming off of the rear holder 85. In this case, for example, the waterproof packing 84 or the waterproof rubber stopper comes off from the connecter housing due to the vibration during the traveling of a vehicle or the locking of the terminals by the rear holder is released. In addition, when the rear holder 85 is incompletely locked into the connector housing 82 (i.e. when the assembly of the rear holder 85 is incomplete), the rear holder 85 easily comes off from the connector housing 82, therefore a measure for securely detecting the incomplete assembly of the rear holder 85 has been desired in order to prevent such a problem from occurring.

SUMMARY OF THE INVENTION

It is therefore an objective of the present invention to solve the above problem and to provide a connector with a holder prevented from coming-off, whereby the unexpected breakaway of the holder from the connector housing can be securely prevented from occurring and the incomplete assembly of the holder with the connector housing can be securely detected.

In order to attain the above objective, the present invention is to provide a connector with a holder prevented from coming-off, comprising: a connector housing; a holder mounted on a surface of the connector housing; a spacer inserted into the middle of the connector housing from a direction crossing at right angles with the mounting direction of the holder; a locking member protrudingly formed to the holder; a locking part for locking formed to the locking member; and an engaging part for engaging with the locking part formed to the spacer, wherein the engaging part engages with the locking part when the holder is completely mounted.

The engaging part can abut on the locking member when the holder is incompletely mounted.

The locking member includes a locking plate, the locking part is a notched hole or a hole part, and the engaging part is a locking projection.

The locking member is inserted into the connector housing.

The engaging part is formed in a hole part of the spacer and the locking member can enter into the hole part of the spacer.

The locking member is situated in the vicinity of an inner wall surface of a vacancy of the connector housing so as to abut on the inner wall surface when the engaging part presses the locking member.

A sealing member is appressed between the holder and the connector housing.

The connector further comprises provisional locking means formed to the holder and complete locking means formed to the spacer, wherein the locking member and the engaging part face rectangularly with each other when the holder and the spacer are in a respective provisionally locked state, the engaging part faces the locking part when the holder is in a completely locked state and the spacer is in a provisionally locked state, and the engaging part engages with the locking part when the holder and the spacer are in a respective completely locked state.

DESCRIPTION OF THE PREFERRED EMBODIMENTS

In the following, the preferred embodiments of the present invention will be explained with reference to the attached drawings.

Figure 1:
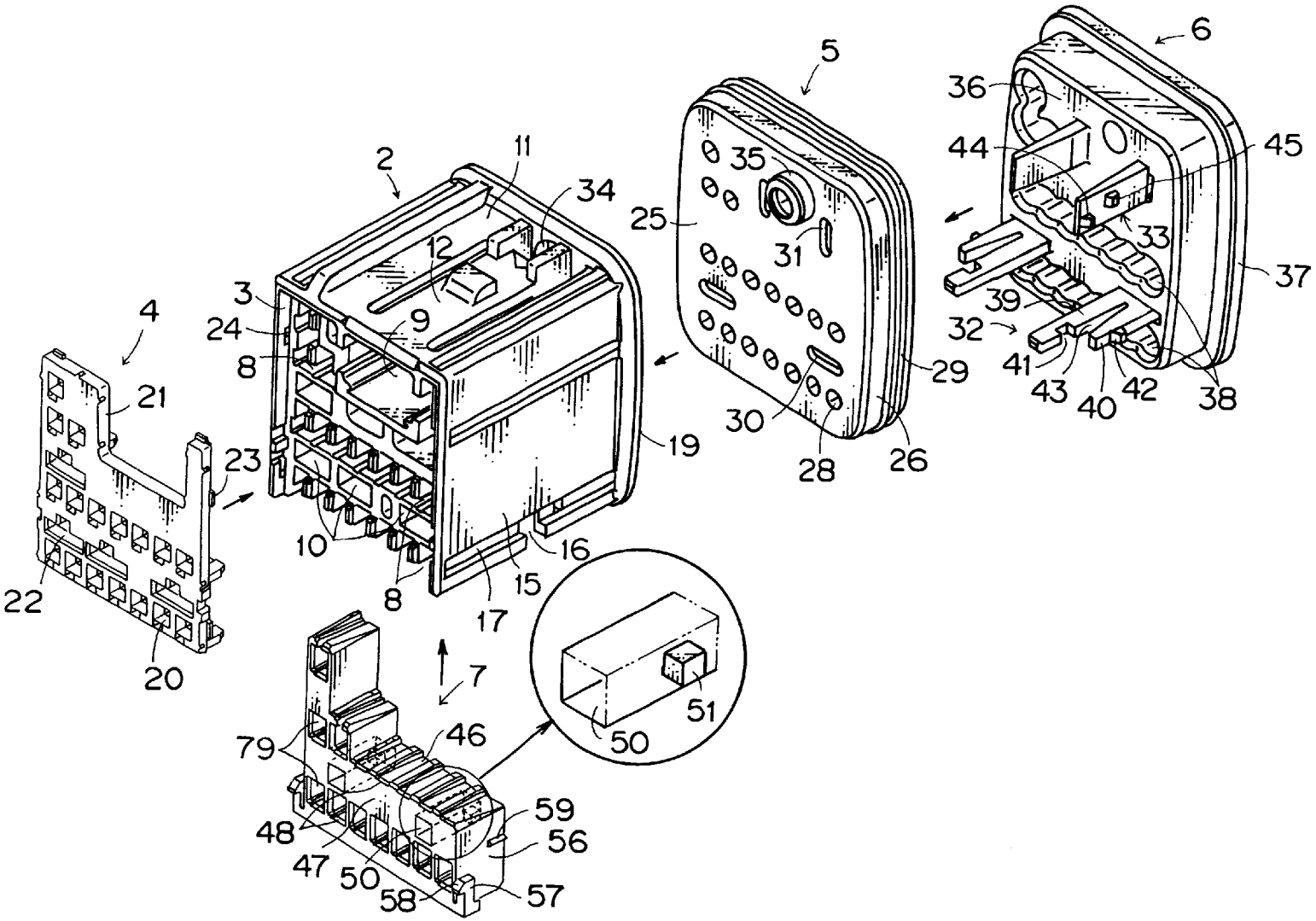
FIG. 1 is an exploded perspective view of a connector with a holder prevented from coming-off according to a preferred embodiment of the present invention.

FIG. 1 is an exploded perspective view of a connector with a holder prevented from coming-off according to a preferred embodiment of the present invention.

As shown in FIG. 1, the connector 1 with a rear holder prevented from coming-off (connector with a holder prevented from coming-off) comprises: a male connector housing 2 made of synthetic resin with the front and rear opened; a front holder 4 made of synthetic resin mounted to the front opening 3; a rectangular-shaped waterproof packing 5 (sealing member) made of synthetic rubber, which fits to the rear end of the connector housing 2; a rear holder 6 (holder) made of synthetic resin, which puts and holds the waterproof packing 5 between itself and the rear of the connector housing 2; a side spacer 7 (spacer) made of synthetic resin for locking terminals (not shown in the figure), which is inserted from the bottom of the connector housing 2 into the interior of the connector housing 2 in a direction crossing at right angles with respect to the mounting direction of the rear holder 6; and the terminals (not shown in the figure) having a wire, which are inserted into the interior of the connector housing 2.

The connector housing 2 comprises: a plurality of terminal receiving chambers 8 opened at the front and back in the parellel and multilayer manner; a chamber 9 for receiving short circuit terminals (not shown in the figure) to detect the electrical conduction between male and female connectors from the front opening 3; and chambers 10 for receiving short circuit terminals (not shown in the figure) to prevent a malfunction of an air bag from occurring from the front opening 3.

On an upper wall 11 of the connector housing 2 there is provided a flexible rocking arm 12 corresponding with a female connector (not shown in the figure) of an opposite side, and at about the center of a lower wall 13 (see FIG. 3) of the connector housing 2 in a direction of the front and back thereof there is provided a lower opening 14 (see FIG. 3) for inserting the side spacer 7. The lower opening 14 communicates with a small rectangular notched part 16 of both sidewalls 15 of the connector housing 2, and the notched part 16 continues to a groove 17 extending in a direction of the front and back of the connector housing 2. At the periphery of the rear of the connector housing 2, a flange 19 is integrally formed, which firmly fits with the front surface of the waterproof packing 5.

The front holder 4 is formed in a rectangular shape and comprises: holes 20 for inserting mating terminals, each of which communicates with the terminal receiving chambers 8 of the connector housing 2; and a notched opening 21 and holes 22 for inserting mating terminals, which communicate with the chamber 9 and chambers 10, respectively. A locking projection 23 is formed at the periphery of the front holder 4, and a locking hole 24 for engaging with the locking projection 23 is formed at the inner periphery of the front opening 3 of the connector housing 2. The existence of the front holder 4 enables the mold release of the connector housing in the direction of the front and back thereof upon manufacturing thereof, that is, making the molding easy. The primary part of the construction according to the present invention, which will be described hereinafter, can be applied to a connector housing (not shown in the figure) without a front holder 4.

The waterproof packing 5 comprises a rectangular base wall 25 and a peripheral wall 26 integrally formed at the outside of the base wall 25, wherein spaces 27 (see FIG. 3) for mounting the rear holder 6 are formed at the inside of the peripheral wall 26. On the base wall 25 there are formed a plurality of insertion holes 28 for inserting wires (not shown in the figure) with terminal in the parellel and multilayer manner, and on the peripheral wall 26 a plurality of lips 29 are formed.

On the lower half of the base wall 25, a pair of long sideways slit-shaped insertion holes 30 is formed at the right and left between two layers of insertion holes 28, while on the upper half of the base wall 25, a pair of longer than is wide slit-shaped insertion holes 31 is formed at the right and left at a little to the one side from the center. Locking members 32 and 33 of the rear holder 6 are inserted into these insertion holes 30 and 31, respectively. Between the upper insertion holes 31, there is formed a cylinder 35 for positioning and for inserting a member for releasing the lock, which engages with a hole 34 formed at the upper side of the flange 19 of the connector housing 2.

The rear holder 6 comprises: a base 36 having the thickess same with the depth of the inner space 27 (see FIG. 3) of the waterproof packing 5; and a flange 37 for pressing formed at the periphery of the rear surface of the base 36, wherein silt-shaped holes 38 for inserting wires are formed in mutilayers on the base. On the lower half of the base 36, a pair of long sideways locking members 32 is formed to protrude forward (in a direction of the mounting of the rear holder onto the connector housing) at the right and left between the two layers of the insertion holes 38, while at a position near to the center on the upper half of the base 36, at the right and left a pair of longer than is wide locking members 33 is formed to protrude forward. The locking members 32 and 33 penetrate through the insertion holes 30 and 31 of the waterproof packing 5, respectively, and protrude within the connector housing 2. Each locking member 32 is inserted into the rear half of the respective chamber 10, which is situated at positions a little to the outside from the center between the first and second layers of the terminal receiving chambers 8.

The lower locking member 32 consists of a long locking plate 39 situated a little near to the inside and a short locking arm 40 situated a little near to the outside. The pair of locking member 32 at the right and left is formed symmetrically. The locking plate 39 extends in a horizontal direction with having a rectangular shape. Near to the end of the locking plate 39 there is provided a rectangular-shape notched hole 41 (locking part). The notched hole 41 is notched in the inner direction from the outside end of the locking plate 39. The notched hole 41 is one of the main elements for the present invention.

The locking arm 40 is disposed about in parallel with the locking plate 39, integrated with the root of the locking plate 39, formed having a thickness same with that of the locking plate 39 in a tapered shape in which the locking arm 40 becomes thin as going to its end, and has a trapezoid-shape complete locking projection 42 (complete locking means) at the outside end of the end of the locking arm 40. The end of the locking arm 40 is situated on about the same plane with the rear end of the notched hole 41 of the locking plate 39. A gap 43 for allowing the locking arm 40 to bend therein is formed between the locking arm 40 and the locking plate 39, wherein the locking arm 40 can bend in a horizontal direction toward the locking plate 39.

The upper locking member 33 is shorter than the locking plate 39 but longer than the locking arm 40, in which the width thereof in the upper-and-lower direction does not change but the width thereof in the right-and-left direction decreases as going to its end. The locking member 33 is so-called locking arm, and has a trapezoid-shape provisional locking projection 44 (provisional locking means) for engaging with the connector housing 2 at the end of the outside surface thereof and a triangular (nail-shaped) complete locking projection 45 (complete locking means) at the middle in the length direction of the outside surface thereof. The locking member 33 can bend in a direction toward the inside similarly to the locking arm 40.

The side spacer 7 has a plurality of terminal insertion holes 79 corresponding to the position of the terminal receiving chambers 8 of the connector housing 2, wherein vertical locking surfaces 48 for doubly locking the terminals at the front ends of the terminal insertion holes 79 and at the front end of the horizontal wall 47, which constitutes a bottom wall 46 of the terminal receiving chamber 8 of the second layer. Below the horizontal wall 47, the terminal insertion holes 79 corresponding to the terminal receiving chamber 8 of the first layer are formed in parallel. The terminal insertion hole 79 matches with the terminal receiving chamber 8 in a provisional locking state of the side spacer 7, while the locking surface 48 protrudes within the terminal receiving chamber 8 in a complete locking state of the side spacer 7.

In the horizontal wall 47 of the side spacer 7, at the right and left a pair of rectangular holes 50 for engaging with the locking plate 39 of the rear holder 6 is penetratingly formed in the front-and-back direction, and near to the rear end of each hole 50 a rectangular locking projection 51 (locking part) for engaging with the notched hole 41 of the locking plate 39 is formed in each hole 50. The locking projection 51 is one of the main elements for the present invention. The width of the hole 50 is a little longer than that of the locking plate 39 that is guided along the hole 50 so that the notched hole 41 of the locking plate and the locking projection 51 in the hole 50 are precisely positioned with each other. The height of the hole 50 is a little longer than the sum of the thickness of the locking plate 39 and the height of the locking projection 51.

Figure 11:
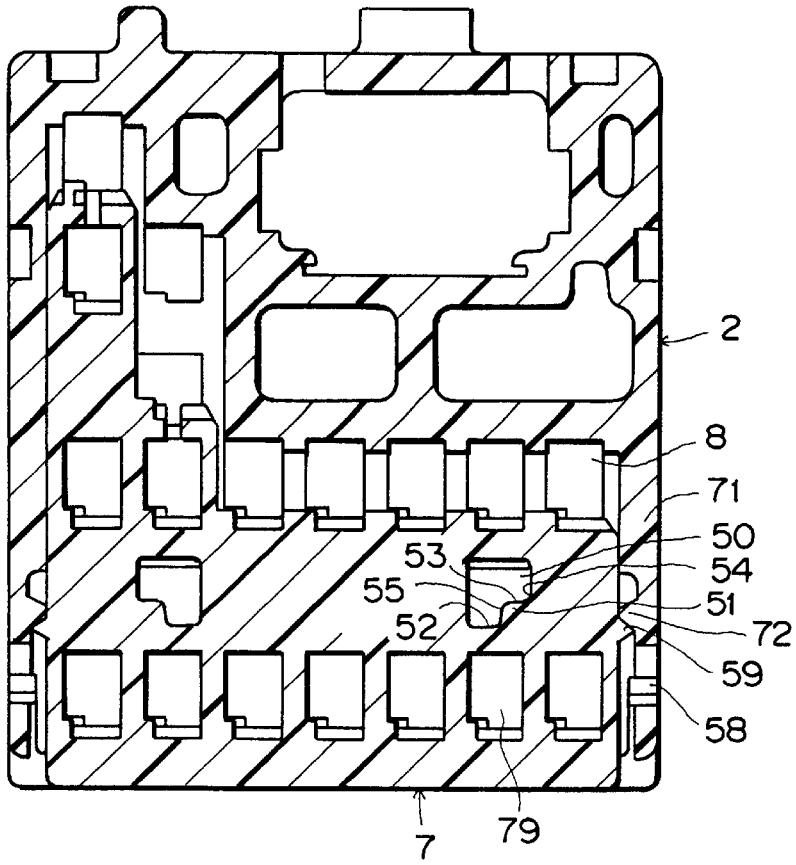
FIG. 11 is a longitudinal sectional view viewed from the front illustrating a provisionally locked state of a side spacer with a connector housing.

According to the present embodiment, the locking projection 51 is disposed a little to the outside of the center in the hole 50 and protrudes upward from the bottom surface 52 (see FIG. 11) of the hole 50, and has its upper end surface 53 at a height of less than half height of the hole 50 as shown in FIG. 11. One end of the locking projection 51 is integrated with one end surface 54 (a surface near to the outside) of the hole 50, while the other side surface 55 (inner surface) of the locking projection 51 crosses at right angles with the bottom surface 52 of the hole 50 at a position near to the center of the bottom surface 52.

As shown in FIG. 1, below and outside of both side surfaces 56 of the side spacer 7, there is protrudingly formed a short provisional locking arm 57 (provisional locking means) for engaging with the connector housing 2 in the height direction. The provisional locking arm 57 has a nail-shaped provisional locking projection 58 facing forward at the end thereof. Above the provisional locking projection 58, a complete locking projection 59 (complete locking means) for engaging with the connector housing 2 at a little rear end side of both side surfaces of the side spacer 7. The provisional locking projection 58 is situated at about the same height with that of the terminal insertion holes 79 of the first layer, whike the complete locking projection 59 is situated a little lower position compared to the position of the locking projection 51 or a projection 72 of the connector housing 2 as shown in FIG. 11.

Figure 2:
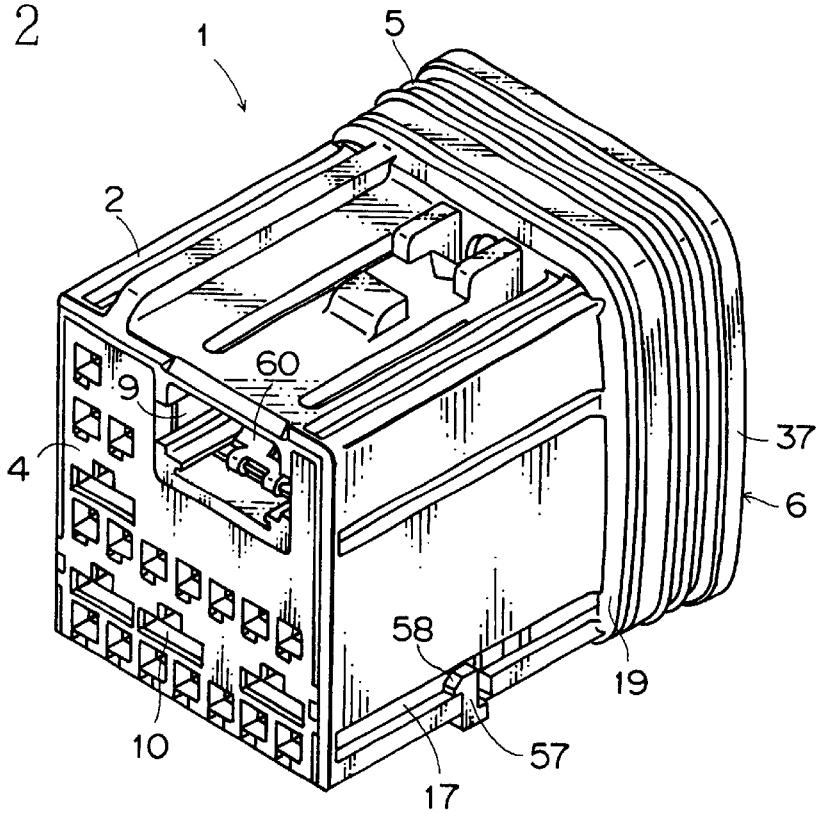
FIG. 2 is a perspective view illustrating an assembly state of the connector with a holder prevented from coming-off according to the present invention.

FIG. 2 is a perspective view illustrating an assembly state of the connector 1 with a holder prevented from coming-off according to the present invention. The front holder 4 is mounted onto the front end of the connector housing 2, the front end surface of the waterproof packing 5 is fit to the flange 19 at the rear end of the connector housing 2, the base 36 (see FIG. 1) of the rear holder 6 is fit to the inner side of the waterproof packing 5, and the flange 37 of the rear holder 6 is fit to the rear end of the waterproof packing 5. Short circuit terminals 60 are inserted into the chambers 9 and 10 of the connector housing 2. The side spacer 7 (see FIG. 1) is inserted from the lower side of the connector housing 2, and the projection 58 of the provisional locking arm 57 is engaged with a groove 17, thereby the provisionally locked state of the side spacer 7 is obtained.

Figure 3:
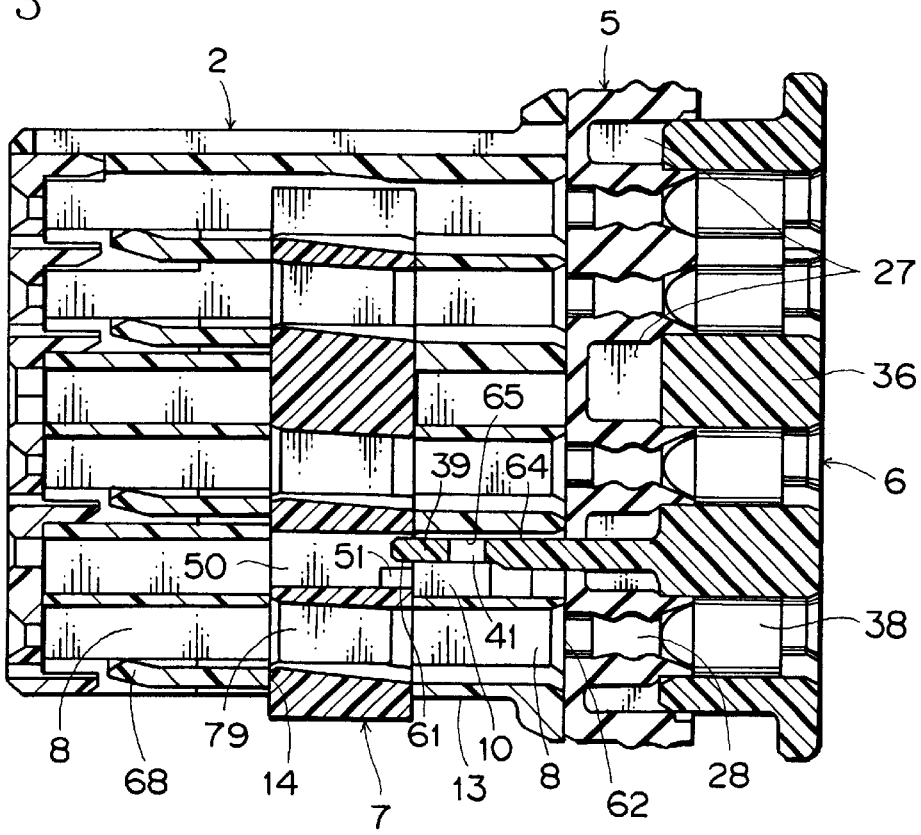
FIG. 3 is a longitudinal sectional view illustrating a state, in which an incomplete insertion of a rear holder is detected in the connector with a holder prevented from coming-off.
Figure 4:
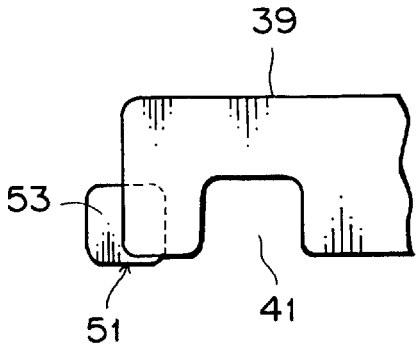
FIG. 4 is a plan view illustrating an abutting state between a locking plate and a locking projection in FIG. 3.

FIG. 3 is a longitudinal sectional view illustrating a state, in which the side spacer 7 is provisionally locked, that is, a state in which the rear holder 6 is incompletely inserted into the connector 1. FIG. 4 is a plan view illustrating an abutting state between a locking plate 39 and a locking projection 51 in FIG. 3. If the complete insertion of the rear holder 6 is not carried out, upon the upward insertion of the side spacer 7, the upper end surface 53 of the locking projection 51 of the side spacer 7 abuts against the lower surface 61 of the locking plate 39 of the rear holder 6, therefore the side spacer 7 cannot be inserted as shown in FIG. 4. Consequently, an operator can find out that the insertion of the rear holder 6 has not carried out, then the operator inserts the rear holder 6 thereinto to obtain the completely locked state thereof.

In the provisionally locked state of the side spacer 7 as shown in FIG. 3, female terminals (not shown in the figure) having wires are inserted into the terminal receiving chambers 8 from the rear opening 62 of the connector housing 2. At this time, each terminal insertion hole 79 of the side spacer 7 is situated concentrically with the terminal receiving chambers 8 and each terminal (not shown in the figure) is inserted into the front half of the terminal receiving chambers 8 by way of the terminal insertion hole 79. Each terminal insertion hole 79 constitutes the middle portion of the respective terminal receiving chambers 8.

Figure 5:
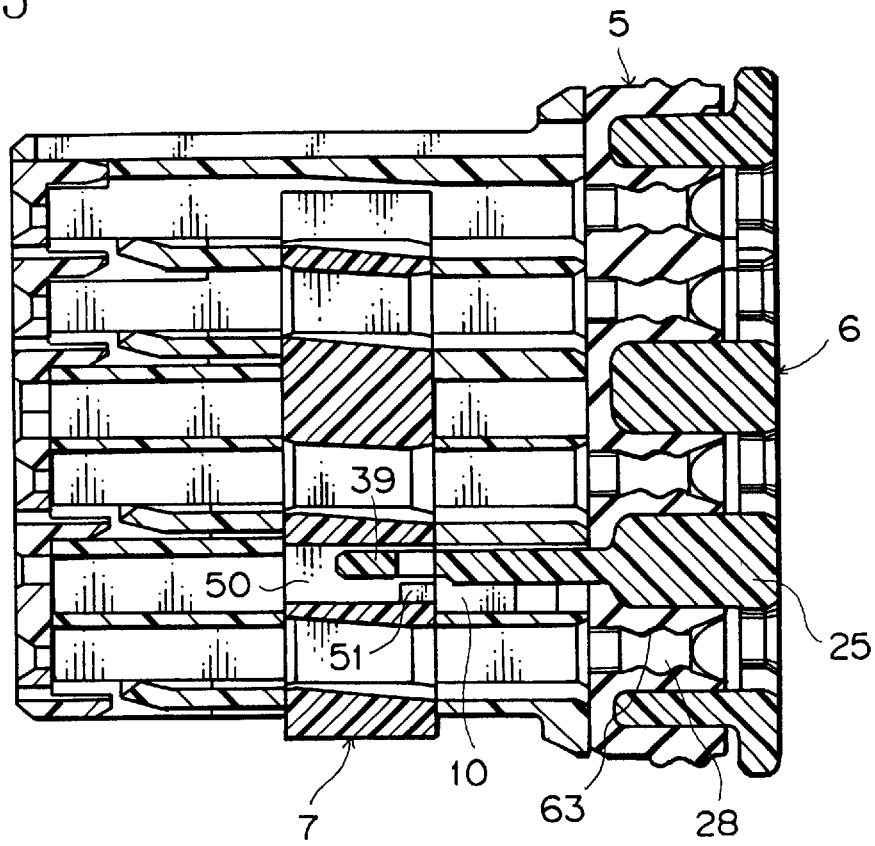
FIG. 5 is a longitudinal sectional view illustrating a state, in which a rear holder is completely mounted.

The wire (not shown in the figure) with terminal may be inserted into the insertion hole 28 of the waterproof packing 5 in advance, then the waterproof packing 5 and the rear holder 6 can be assembled with each other. Instead, in order to omit said pre-assemply and to improve the workability of the assembly, in the provisionally locked state of the rear holder 6 as shown in FIG. 3, the terminal having a wire can be inserted into the connector housing 2 from the terminal insertion hole 28 of the flexible waterproof packing 5 by way of the holes of the rear holder 6, then each lip 63 is pushed toward the outside and bends in a space 27 for fitting, thereby the terminals can be easily inserted. Then, as shown in FIG. 5, the rear holder 6 is fit into the inside of the waterproof packing 5 and the base 36 of the rear holder 6 presses the wire insertion holes 28 to shrink their diameter, and the lip 63 in the wire insertion hole 28 fastens the wires, thereby the wire can be brought into intimate contact with the lip 63.

As shown in FIG. 3, each rectangular chamber 10 is formed between the terminal insertion chambers 8 of the first and second layers from the bottom of the connector housing 2, into which the locking plate 39 and the locking arm 40 of the rear holder 6 (see FIG. 1) are inserted. The chamber 10 also functions as a chamber for receiving an open circuit terminal, thereby making a good use of the space for receiving the locking plate 39 and the locking arm 40, that is, the locking member 32.

The locking plate 39 together with the locking arm 40 penetrates through the long sideways slit-shaped insertion holes 30 (see FIG. 1) of the waterproof packing 5 to protrudes to the rear half of the chamber 10 and the end of the locking plate 39 advances into a rectangular hole 50 of the side spacer 7 in the provisionally locked state of the rear holder 6. The chamber 10 matches concentrically with the hole 50 in the provisionally locked state of the side spacer 7. The locking plate 39 is situated above the chamber 10 and the upper surface 64 of the locking plate 39 closely faces an upper inner wall surface 65 of the chamber 10. Thus, when the locking projection 51 of the side spacer 7 pushes the locking plate 39 up, the locking plate 39 abuts on the inner wall surface 65 of the chamber 10, the locking plate 39 is prevented from bending, and the locking projection 51 is provided with higher capability of abutting, thereby the side spacer 7 is securely prevented from being pushed into the connector housing 2.

Figure 6:
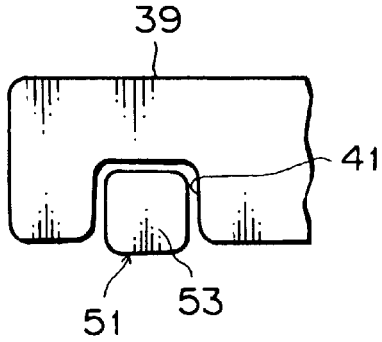
FIG. 6 is a plan view illustrating a positional relationship between a notched hole for locking and a locking projection in FIG. 5.

In the provisionally locked state of the side spacer 7, an upper end surface of the locking projection 51 is closely situated at a lower surface of the end of the locking plate 39. Thus, the rear holder 6 is pushed forward as shown in FIG. 5, then the end of the locking plate 39 smoothly advances into the hole 50 of the side spacer 7 without being interfered by the locking projection 51 of the side spacer 7 and then, the rear holder 6 is completely pushed into and mounted thereinto. On this state, as shown in FIG. 6, the notched hole 41 of the locking plate 39 is situated concentrically with the upper end surface 53 of the locking projection 51.

Figure 7:
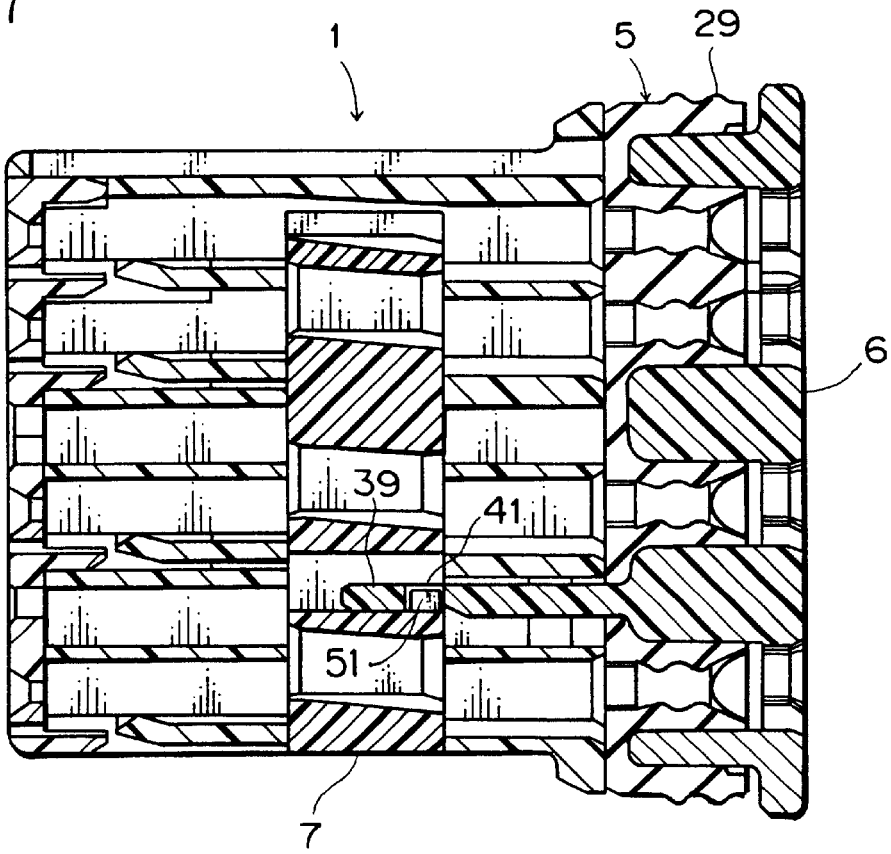
FIG. 7 is a longitudinal sectional view illustrating a state, in which a side spacer is completely inserted to lock a rear holder.
Figure 8:
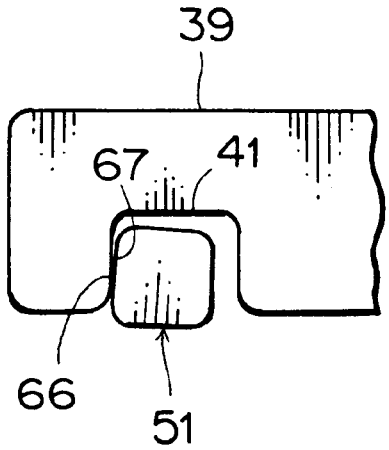
FIG. 8 is a plan view illustrating an engaging state between a notched hole for locking and a locking projection in FIG. 7.

Then, as shown in FIG. 7, the side spacer 7 is pushed in upward, the locking projection 51 advances into the noched hole 41 of the locking plate 39, thereby the rear holder 6 is prevented from coming off backward. That is, when the backward force is applied to the rear holder 6 due to a tension by a wire with terminal and the like, as shown in FIG. 8, the front end surface 66 of the locking projection 51 abuts against an front end surface 67 of the notched hole 41 of the locking plate 39, thereby the rear holder 6 is securely prevented from moving backward. The locking projection 51 abuts against the notched hole 41 with a surface contact, the locking plate 39 extends straightly in the horizontal direction, and the locking plate 39 shows neither buckling nor extension in the back-and-force direction, therefore the firm locking force is attained for the ear holder 6.

The following construction is also possible. That is, as shown in FIG. 5 the side spacer 7 is inserted into the connector housing 2 on a state that the rear holder 6 is pushed forward to compress the waterproof packing 5, thereby as shown in FIG. 6 the locking projection 51 advances into the notched hole 41 of the locking plate 39, then as shown in FIG. 7 the pushing of the rear holder 6 is ceased, thereby the rear holder 6 is pushed backward by an elastic force of the waterproof packing 5 and as shown in FIG. 8 the front end 66 of the locking projection 51 can abut against the front end 67 of the notched hole 41. With the construction mentioned above, the waterproof packing 5 firmly fits between the connector housing 2 and the rear holder 6, thereby giving a good sealing property there and securely preventing the back-lash between the waterproof packing 5 and the rear holder 6.

In FIG. 3, a flexible locking lance 68 is integrally formed to the lower wall 13 of the terminal receiving chamber 8 in order to provisionally lock the terminal. When the connector 1 is coupled with a mating female connector (not shown in the figure) in a complete assembled state (a state in which the terminals also are inserted), the lip 29 of the waterproof packing 5 can be fit, for example, to a wall surface in a fitting chamber of a housing of the mating female connector (not shown in the figure).

Figure 9:
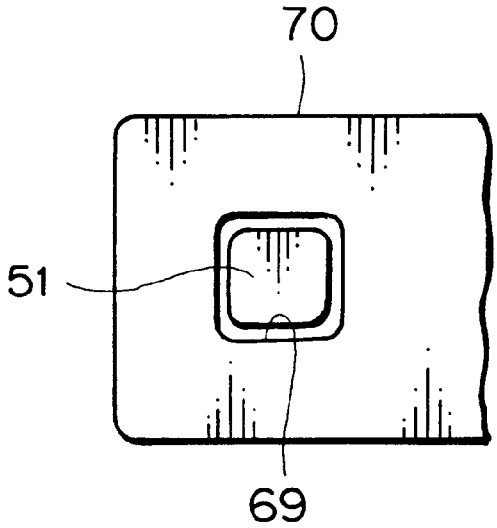
FIG. 9 is a plan view illustrating a locking plate and its hole according to another embodiment.

Instead of the locking plate 39 shown in FIG. 6, it is possible to employ a locking plate 70 having a rectangular hole 69 (i.e. locking part) as shown in FIG. 9. The locking plate 39 in FIG. 6 has narrow width and can be compactly formed corresponding to a narrow terminal receiving chamber 8. On the other hand, the locking plate 70 in FIG. 9 is suitable to a terminal receiving chamber for receiving a large terminal such as a power supply terminal and since the right and left, and the front and behind of a hole 69 are all closed, no deformation of the hole 69 occurs, thereby a locking force to the locking projection 51 is increased.

Figure 10:
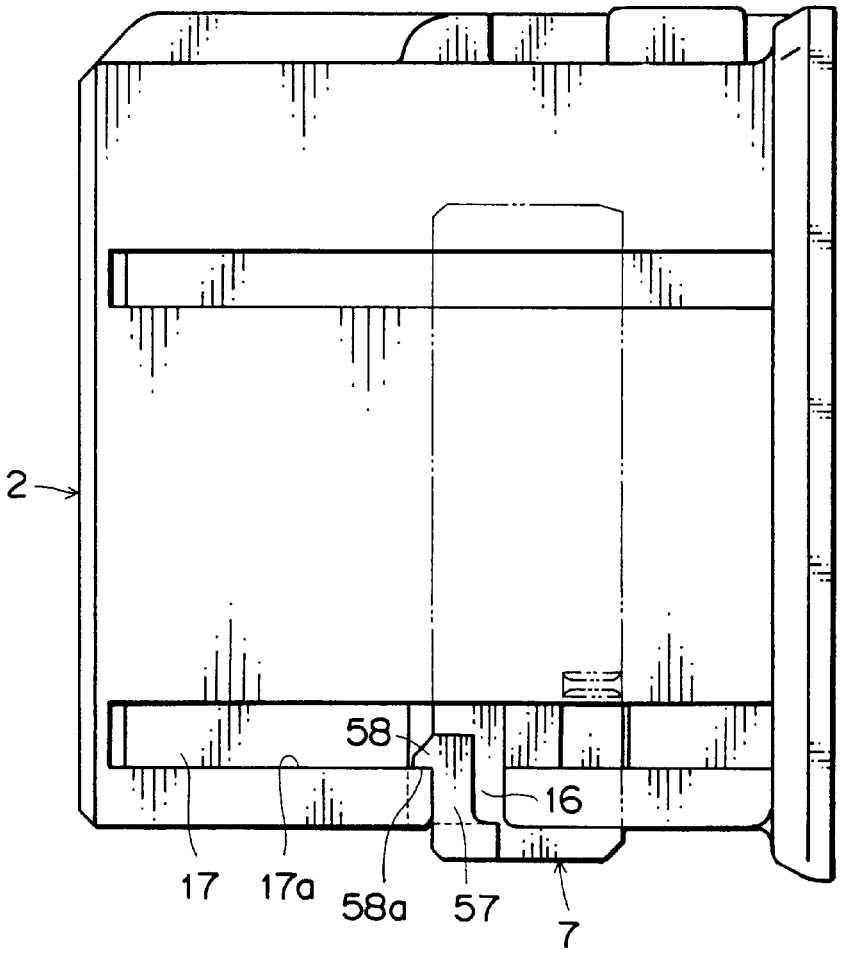
FIG. 10 is a side view illustrating a provisionally locked state of a side spacer with a connector housing.

FIG. 10 is a side view illustrating a provisionally locked state of a side spacer 7 with a connector housing 2. FIG. 11 is a longitudinal sectional view viewed from the front illustrating a provisionally locked state of a side spacer 7 with a connector housing 2. As shown in FIG. 10, the side spacer 7 a little protrudes from the bottom of the connector housing 2, each provisional locking arm 57 is situated in the notched part 16, a horizontal locking surface 58*a* of the provisional locking projection 58 abuts against a lower surface 17*a* of a horizontal groove 17, and in this state, as shown in FIG. 11 an upper inclined surface of the complete locking projection 59 of the side spacer 7 abuts against a lower inclined surface of a projection 72 of an inner wall 71 of the connector housing 2, thereby the side spacer 7 is provisionally locked with the connector housing 2 without back-lash.

The provisional locking arm 57 slides on an inner surface of the notched part 16 with bending backward when the side spacer 7 is inserted into the connector housing 2, thereby allowing the projection 58 to advance into the groove 17. In FIG. 11, abbreviation numeral 8 denotes a terminal receiving chamber, 79 a terminal insertion hole, 50 a hole to allow the locking plate 39 of the rear holder 6 (see FIG. 1) to advance, and 51 a locking projection to fit to the locking plate 39.

Figure 12:
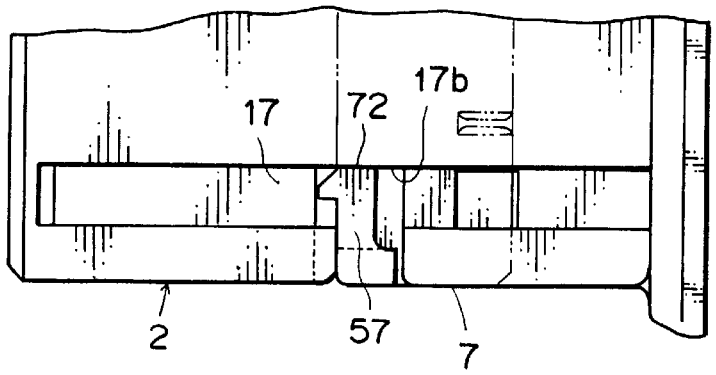
FIG. 12 is a side view illustrating a completely locked state of a side spacer with a connector housing.
Figure 13:
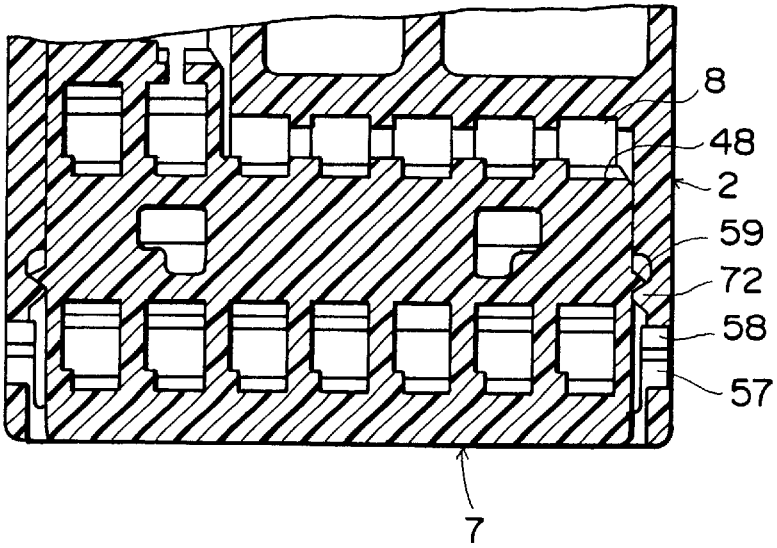
FIG. 13 is a longitudinal sectional view illustrating a completely locked state of a side spacer with a connector housing.

FIG. 12 is a side view illustrating a completely locked state of a side spacer 7 with a connector housing 2. FIG. 13 is a longitudinal sectional view illustrating a completely locked state of a side spacer 7 with a connector housing 2. As shown in FIG. 12, when the side spacer 7 is pushed into the connector housing 2, the provisional locking arm 57 of the side spacer 7 rises without suffering resistance and an upper end 72 of the arm 57 abuts against an upper end surface 17*b* of the groove 17. At the same time, as shown in FIG. 13 the complete locking projection 59 climbs over the projection 72 of the connector housing 2 and a lower inclined surface of the complete locking projection 59 abuts against an upper inclined surface of the projection 72, thereby the side spacer 7 is completely locked with the connector housing 2 without back-lash.

In the complete locked state shown in FIG. 13, an opening area of the terminal receiving chamber 8 is reduced by a locking surface 48 (upper front end surface) and, for example, a rear end (shoulder part) of a box-shaped electrical contact of a female terminal (not shown in the figure) is secondary locked by the locking surface 48.

Figure 14:
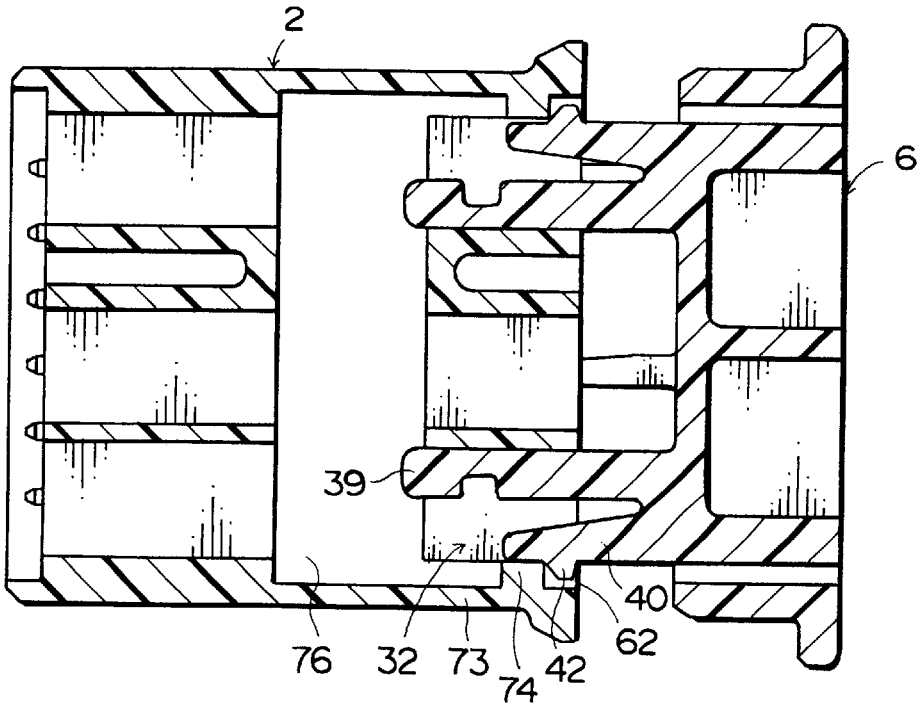
FIG. 14 is a transverse sectional view illustrating a state of a lower locking member on a condition that a rear holder is provisionally locked.
Figure 15:
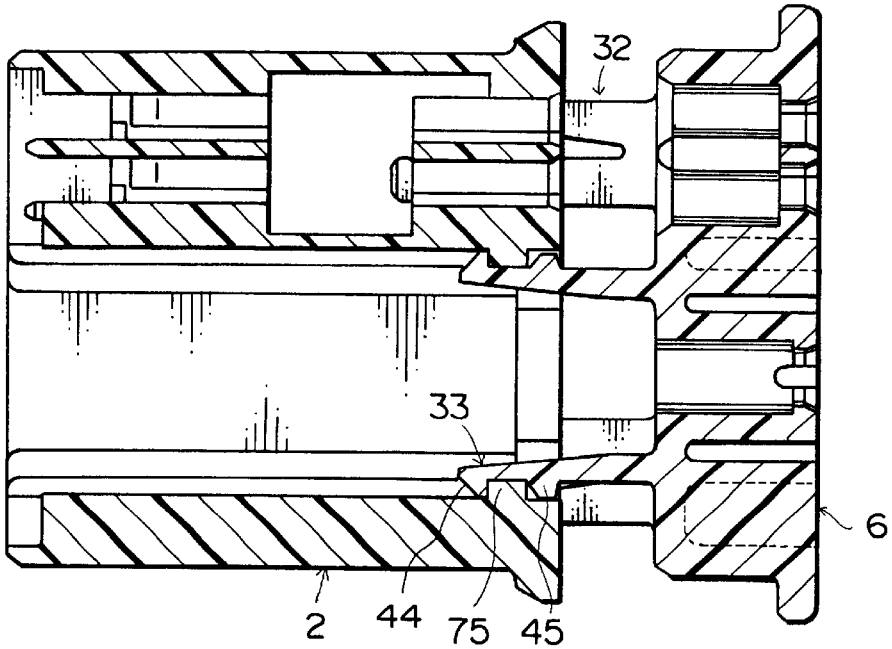
FIG. 15 is a transverse sectional view illustrating a state of an upper locking member on a condition that a rear holder is provisionally locked.

FIG. 14 is a transverse sectional view illustrating a state of the lower locking member 32 of the rear holder 6 on a condition that the rear holder 6 is provisionally locked to the connector housing 2. FIG. 15 is a transverse sectional view illustrating a state of the upper locking member 33 on a condition that the rear holder 6 is provisionally locked to the connector housing 2. The waterproof packing 5 is omitted in FIGS. 14 and 15.

As shown in FIG. 14, an inclined surface at a front end of a projection 42 (complete locking projection) of the locking arm 40 of the lower locking member 32 abuts against a vertical surface at the rear end of a projection 74 having a rectangular shape for its transverse cross section on an inner surface of the sidewall 73 of the connector housing 2, as shown in FIG. 15, a provisional locking projection 44 (i.e. provisional locking means) at the front end side of the upper locking member 33 (i.e. locking arm) climbs over a projection 75 having a rectangular shape for its transverse cross section of the connector housing 2, a locking surface at the rear end of the provisional locking projection 44 abuts against the front end of the projection 75, and an inclined surface at the front end of the complete locking projection 45 (i.e. complete locking means) situated at an intermediate position abuts against the rear end surface of the projection 75, that is, the projection 75 is sandwiched between the provisional locking projection 44 and the complete locking projection 45, thereby the rear holder 6 is securely provisionally held without back-lash in the back-and-forth direction.

The waterproof packing 5 is penetrated by the locking members 32 and 33 of the rear holder 6 in the provisionally locked state of the rear holder 6, therefore the waterproof packing 5 never comes off. The projections 74 and 75 may be continuously formed in the height direction on an inner surface of both saidwalls 73 at a position a little front side from the rear opening 62. In FIG. 14, the front end of the locking plate 39 protrudes a little toward a space 76 for receiving the side spacer 7. In FIG. 15, an abbreviation numeral 32 denotes the lower locking member.

Figure 16:
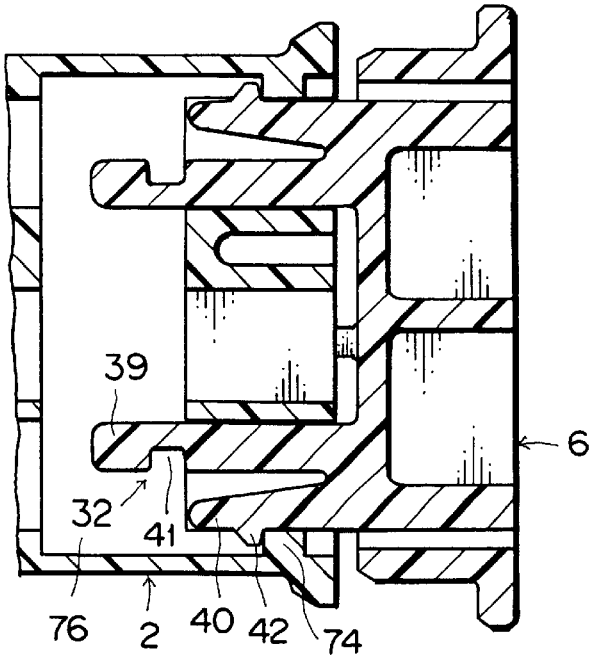
FIG. 16 is a transverse sectional view illustrating a state of a lower locking member on a condition that a rear holder is completely locked.
Figure 17:
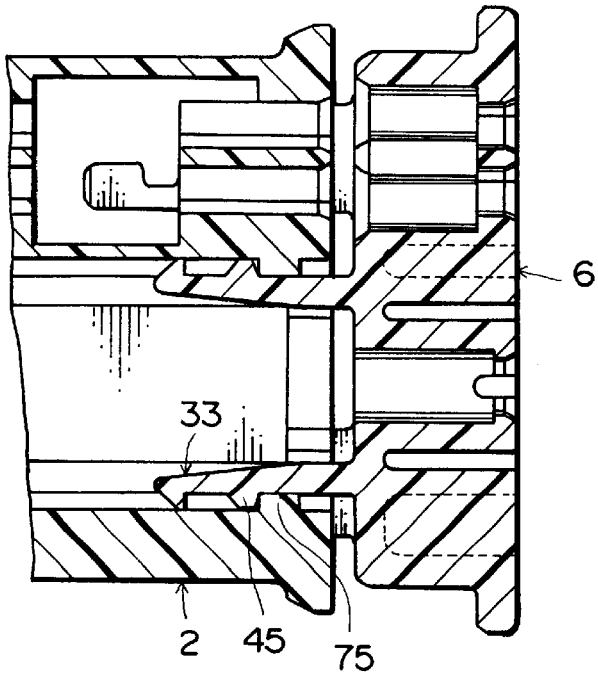
FIG. 17 is a transverse sectional view illustrating a state of an upper locking member on a condition that a rear holder is completely locked.
Figure 18:
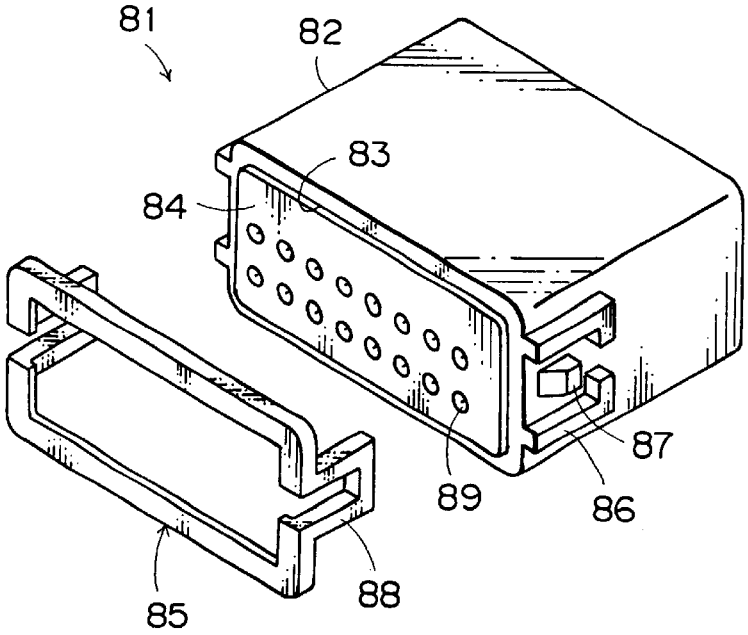
PRIOR ART FIG. 18
FIG. 18 is an exploded perspective view illustrating a conventional connector with a rear holder.

FIG. 16 is a transverse sectional view illustrating a state of a lower locking member 32 of the rear holder 6 on a condition that a rear holder 6 is completely locked to the connector housing 2. FIG. 17 is a transverse sectional view illustrating a state of an upper locking member 33 of the rear holder 6 on a condition that a rear holder 6 is completely locked to the connector housing 2.

As shown in FIG. 16, the projection 42 of the lower locking arm 40 climbs over the projection 74 of the connector housing 2 while the locking arm 40 bends toward the inside, a steeply inclined surface at the rear end of the projection 42 abuts against the front end of the projection 74, as shown in FIG. 17 the complete locking projection 45 situated at the middle of the locking arm 33 climbs over the projection 75 of the connector housing 2 while the upper locking arm 33 bends toward the inside, a steeply inclined surface at the rear end of the complete locking projection 45 abuts against the front end of the projection 75. At this time, the waterproof packing 5 is held on its compressed condition between the rear end of the connector housing 2 and the front end of the rear holder 6, thereby the rear holder 6 and the waterproof packing 5 are securely fixed without back-lash.

Since each locking member 32 and 33 is received not outside but inside of the connector housing 2, each locking member 32 and 33 does not suffer any interference from the outside and the rear holder 6 does not come off abruptly. At the worst, even if the complete locking of the rear holder 6 is released, since the rear holder 6 is held to the connector housing 2 by the provisional locking means 44, as shown in FIG. 3 the front end of the base 36 of the rear holder 6 a little engages with the inner space 27 of the waterproof packing 5, the waterproof packing 5 is held in a state that the rear holder 6 pushes, even a little, the waterproof packing 5 against the connector housing 2, thereby the sealing property is ensured there. In FIG. 16, the notched hole 41 of the locking plate 39 is situated in a space 76 for receiving the side spacer 7 in the connector housing 2.

As the sealing member, a waterproof rubber stopper for each terminal receiving chamber 8 instead of the aforementioned waterproof packing 5 may be used to prevent the waterproof rubber stopper from coming off by pressing each waterproof rubber stopper with the rear holder. Instead, the rear holder 6 may be provided with a shaft (not shown in the figure) for locking a terminal so that the terminal is primarily locked with the side spacer 7 and secondary locked by the shaft. In such a case the sealing member may not be used.

Instead of using the rear holder 6, the front holder (or holder) may be provided with a locking plate or locking member so that a notched hole of the locking plate can be engaged with the locking projection 51 of the side spacer 7. The construction consisting of the locking plate 39 of the rear holder 6 and the locking projection 51 of the side spacer 7 can be applied to a connector housing without the front holder 4. If the abutting function between the locking plate 39 of the rear holder 6 and the locking projection 51 of the side spacer 7 is not considered, the locking plate 39 of the rear holder 6 may be provided with the locking projection 51 and the side spacer 7 may be provided with the notched hole 41 or the hole 69 shown in FIG. 9. If the thickness of the locking plate 39 can be set large, a hollow groove instead of the notched hole 41 or the hole 69 may be formed. The shape of the locking projection or the holes 41 and 69 is not limited to rectangular and may be round.

The aforementioned preferred embodiments are described to aid in understanding the present invention and variations may be made by one skilled in the art without departing from the spirit and scope of the present invention.

According to the present invention, the engaging part of the spacer engages with the locking part of the holder upon complete mounting of the holder to the connector housing, thereby the holder is securely prevented from coming off. Even if the holder suffers with any interference from the outside such as a strong tension, the holder does not come off. Therefore, for example, the waterproof packing, which is fit into between the holder and connector housing, is securely prevented from coming off and terminals inserted in the connector housing are securely prevented from coming out.

What is claimed is:

1. A connector with a holder prevented from coming-off, comprising:

a connector housing;

a holder for retaining a sealing member, being mounted on a surface of the connector housing;

a spacer inserted into the middle of the connector housing from a direction crossing at right angles with a mating direction of the holder;

a locking member protrudingly formed on the holder;

a locking part for locking formed on the locking member; and an engaging part for engaging with the locking part formed on the spacer, wherein the engaging part engages with the locking part when the holder is completely mounted.

2. The connector with a holder prevented from coming-off according to claim 1, wherein the engaging part can abut on the locking member when the holder is incompletely mounted.

3. The connector with a holder prevented from coming-off according to claim 1 or 2, wherein the locking member includes a locking plate, the locking part is a notched hole or a hole part, and the engaging part is a locking projection.

4. The connector with a holder prevented from coming-off according to claim 1 or 2, wherein the locking member is inserted into the connector housing.

5. The connector with a holder prevented from coming-off according to claim 4, wherein the engaging part is formed as a hole part of the spacer and the locking member can enter into the hole part of the spacer.

6. The connector with a holder prevented from coming-off according to claim 1 or 2, wherein the locking member is situated in the vicinity of an inner wall surface of a cavity of the connector housing so as to abut the inner wall surface when the engaging part presses the locking member.

7. The connector with a holder prevented from coming-off according to claim 1 or 2, wherein a sealing member is pressed between the holder and the connector housing.

8. The connector with a holder prevented from coming-off according to claim 1 or 2, further comprising provisional locking means formed on the holder and complete locking means formed to the spacer, wherein the locking member and the engaging part face each other when the holder and the spacer are in a respective provisionally locked state, the engaging part faces the locking part when the holder is in a completely locked state and the spacer is in a provisionally locked state, and the engaging part engages with the locking part when the holder and the spacer are in a respective completely locked state.

* * * * *